United States Patent [19]

Childers

[11] Patent Number: 4,527,459

[45] Date of Patent: Jul. 9, 1985

[54] SMALL ARMS AMMUNITION LOADING SYSTEM

[75] Inventor: Carroll D. Childers, Fredericksburg, Va.

[73] Assignee: The United States of America as represented by the Secretary of the Navy, Washington, D.C.

[21] Appl. No.: 524,186

[22] Filed: Aug. 17, 1983

[51] Int. Cl.[3] ..... F41D 10/02

[52] U.S. Cl. ..... 89/161; 89/33.1

[58] Field of Search ..... 89/33.1, 161; 42/11

[56] References Cited

U.S. PATENT DOCUMENTS

| | | | |
|---|---|---|---|
| 715,971 | 12/1902 | Burgess | 89/161 |
| 1,179,880 | 4/1916 | Wesson | 42/11 |
| 2,851,928 | 9/1958 | Hultgren et al. | 89/45 |
| 3,410,173 | 11/1968 | Piskator | 89/33.1 |
| 3,667,147 | 6/1972 | Goldin et al. | 42/15 |
| 3,736,839 | 6/1973 | Childers | 89/161 |
| 3,890,729 | 6/1975 | Frisoli | 89/33.1 |
| 4,019,424 | 4/1977 | Reynolds | 42/11 |
| 4,038,904 | 8/1977 | Rocha | 89/33.03 |

*Primary Examiner*—Stephen C. Bentley

*Attorney, Agent, or Firm*—Robert E. Beers; Kenneth E. Walden; Donald J. Breh

[57] ABSTRACT

An automatic ammunition transfer device is disclosed. A reciprocating chamber block includes a stripper tab for moving ammunition rounds from the magazine into a round carrier mechanism. The round carrier mechanism includes spring load fingers for holding the round. The mechanism, with round therein, is moved from a stagging position to a chambering position for insertion of the round into the firing chamber by a four bar linkage arrangement. The four bar linkage is pivoted between the stagging and chambering positions in timed relation with the chamber block movement, as determined by a cam path located on the chamber block.

3 Claims, 12 Drawing Figures

FULL BATTERY

SMALL ARMS AMMUNITION LOADING SYSTEM

BACKGROUND OF THE INVENTION

This invention relates to ammunition loading systems and more particularly to loading systems for use in automatic weapons of the type having a forward moving barrel and chamber with a magazine for holding cartridges to be inserted successively into the chamber.

In field operation of weapons utilizing magazines to hold cartridges or other ammunition rounds, it is desirable to maintain positive control over the round at all times so that it will be transfered from the magazine and inserted into the chamber without jamming. It is also desirable to provide for a loading mechanism that allows the weapon to be operated in any position without loss of control over the round. Heretofore, when a weapon has been operated in an attitude other than horizontal, there has existed a high probabilty that successive rounds will fail to chamber and cause jamming or misfire.

Typically the rounds are stored under spring force which accelerates the round from the magazine into a loading tray. The round lays in the tray unrestrained until acted upon by other mechanism, such as a bolt, to force it into the firing chamber These systems generally work well so long as the weapon is in a horizontal position and a near vertical relationship exists between the firing chamber and loading tray. When the gun is moved from the vertical, a jam or failure to chamber can occur. It can be appreciated that it is highly desirable to provide for an ammunition loading mechanism that maintains positive control over the ammunition continuously from the magazine until it is inserted into the firing chamber.

SUMMARY OF THE INVENTION

It is the primary object of the invention to provide for an automatic ammunition loading system that allows a gun to be loaded and fired in any position without jamming.

Another object of the invention is to provide for an ammunition loading mechanism that maintains positive control over the ammunition at all times.

The objects are achieved by providing for a loading mechanism that engages and holds each ammunition round from the time it is stripped from the magazine to the time it is inserted into the firing chamber. A four bar linkage arrangement pivots according to a precise sequence, as determined by a cam path, and moves a spring loaded round engaging assembly between a stagging position and chambering position.

FIGS. *6a–6g* are diagramatic representations of the sequence of operation of the preferred embodiment.

DETAILED DESCRIPTION OF THE PREFERRED EMBODIMENT

Figure 1:
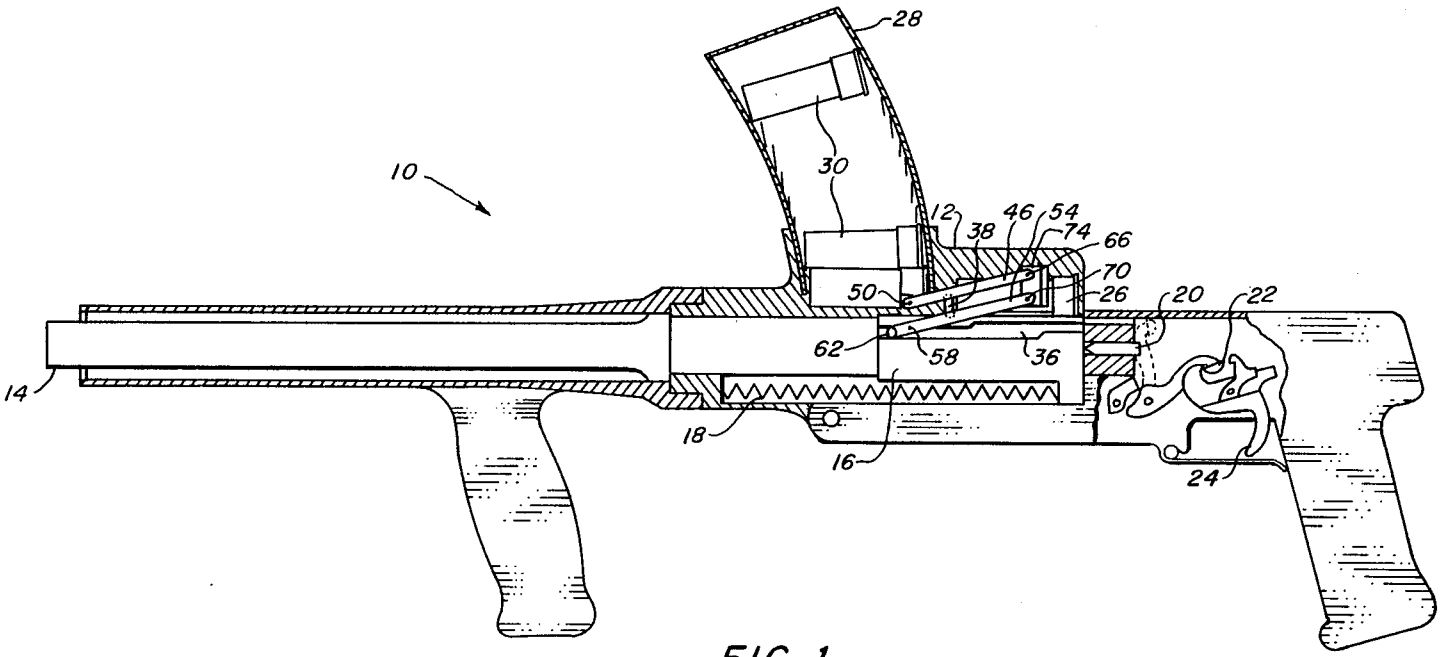
FIG. 1 is a longitudinal cross section of a gun showing the preferred embodiment in use.

Shown in FIG. 1 is an automatic gun 10 of the type having a case 12 and a forward moving barrel 14 attached to a forward moving chamber assembly 16. Chamber assembly 16 is attached to barrel 14 and both move in reciprocating fashion during operation. Barrel 14 and chamber assembly 16 are biased toward the in battery position, shown in FIG. 1, by a spring 18. A conventional firing pin 20, hammer 22, and trigger 24 arrangement are located adjacent firing chamber assembly 16 for striking an ammunition round. The gun shown is representative only, and the ammunition transfer mechanism of the present invention is applicable to other gun designs of the type having a reciprocating barrel and chamber assembly.

Figure 2:
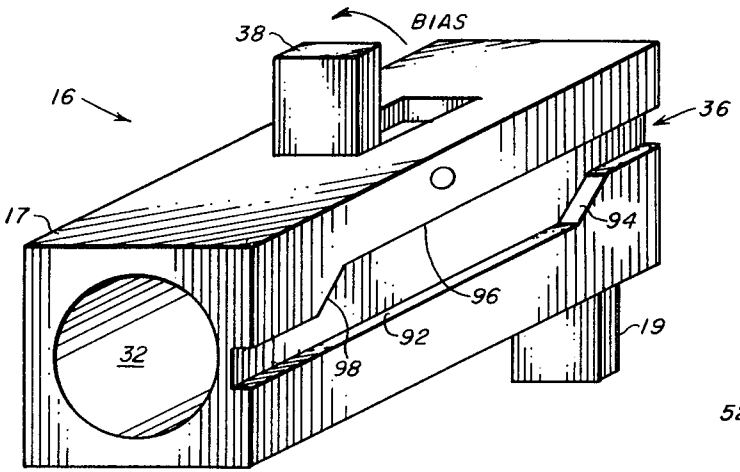
FIG. 2 is a perspective view of the chamber block assembly showing details of its construction.

A magazine 28 holds a plurality of ammunition rounds 30 in conventional manner, which are to be transferred to and inserted into a firing chamber 32, see FIG. 2, in chamber assembly 16 by a round transfer mechanism. The round transfer mechanism includes two major assemblies, the details and operation of which are described hereinbelow. The first assembly is chamber assembly 16 that includes a cam path 36 on opposite sides of a chamber block 17, and a round stripper tab 38, as shown in FIG. 2. Stripper tab 38 is spring loaded toward the extended position as shown in FIGS. 1 and 2. Chamber block 17 also includes a tab 19 for receiving return spring 18. The second assembly is an ammunition round carrier assembly 40 shown in FIG. 3. The round carrier assembly includes a four bar linkage arrangement 42 pivotably connected to the gun case and to a round engaging finger arrangement 44.

Figure 3:
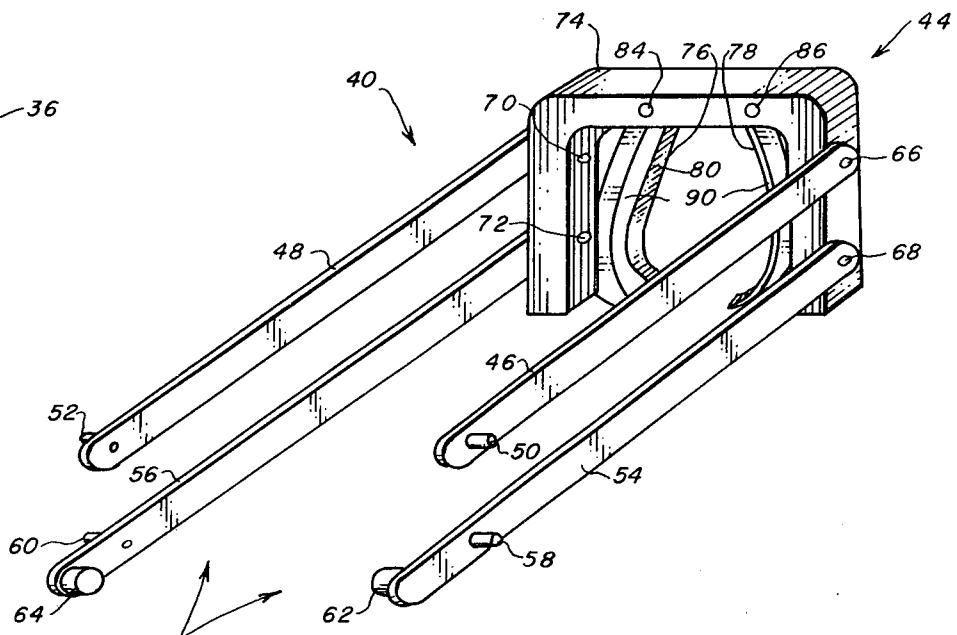
FIG. 3 is a perspective view of the round carrier assembly showing details of its construction.

Referring to FIGS. 1 and 3, a first pair of linkage members 46, 48 are each pivotably connected to the gun case at one end through pins 50, 52. A second pair of linkage members 54, 56 are also pivotably connected to the gun case through pins 58, 60 located adjacent one end. Pivot pin pairs 50, 58 and 52, 60 are respectively located on axis perpendicular to the longitudinal axis of the gun barrel and chamber assembly. Second linkage pair members 54, 56, each include a cam follower 62, 64 that rides in and follows cam path 36 as set out below. Because both sides of the chamber block are identical, reference will be made to only one side when necessary.

Figure 4:
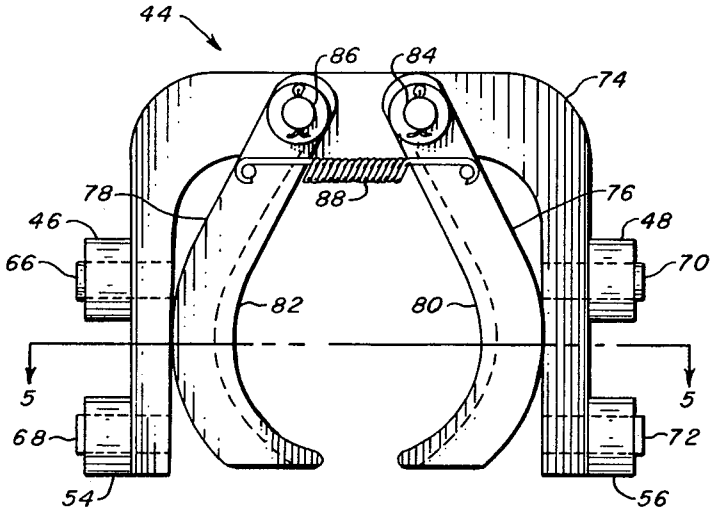
FIG. 4 is an end view of the round carrier assembly.
Figure 6A:
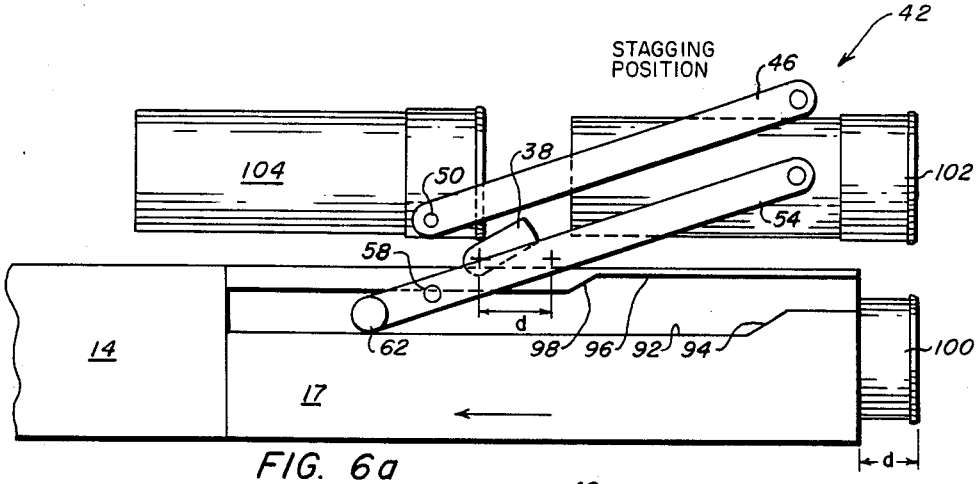
Figure 6B:
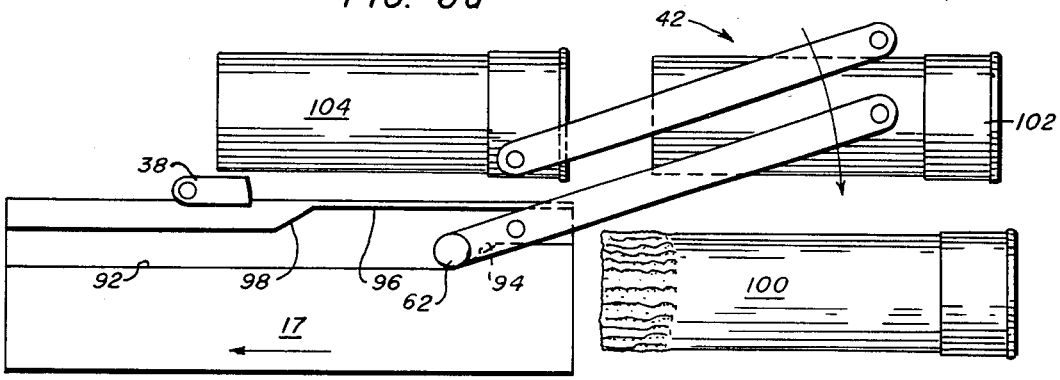
Figure 6C:
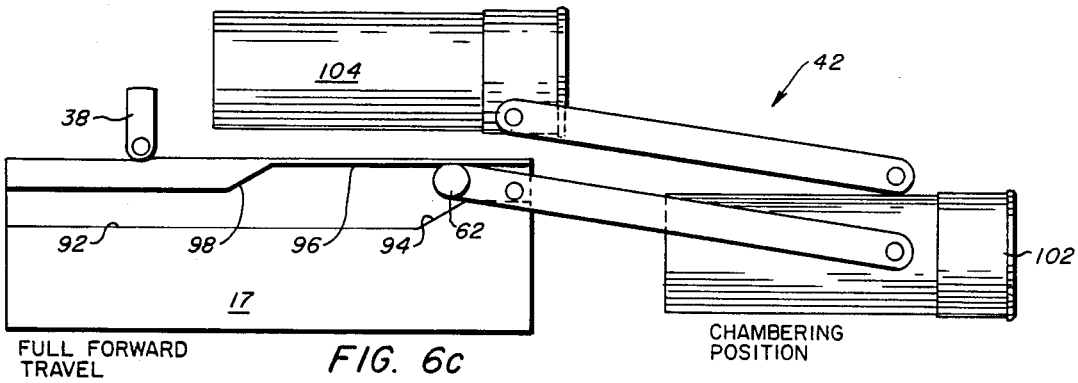
Figure 6D:
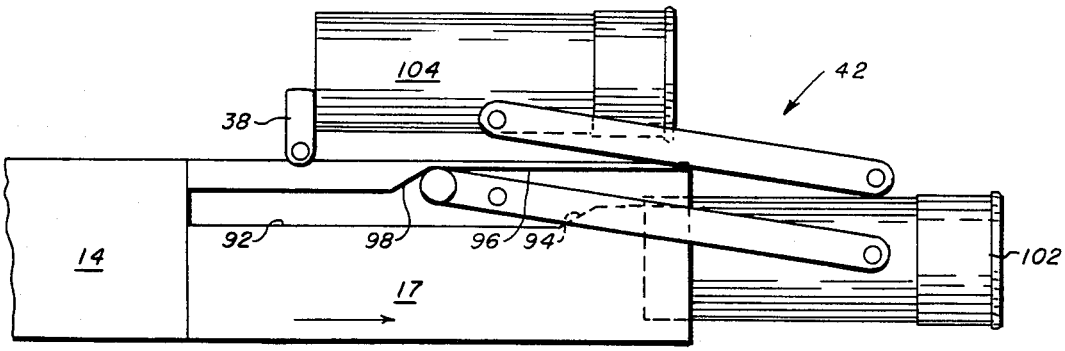
Figure 6E:
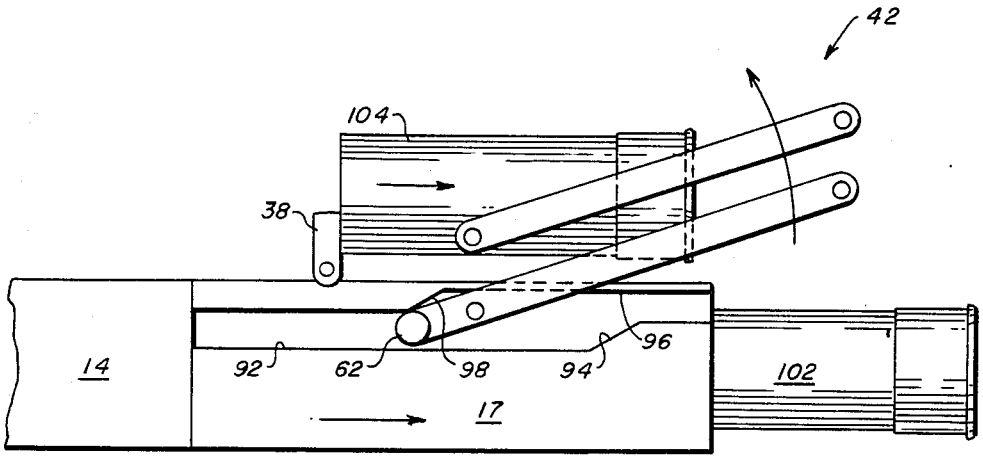
Figure 6F:
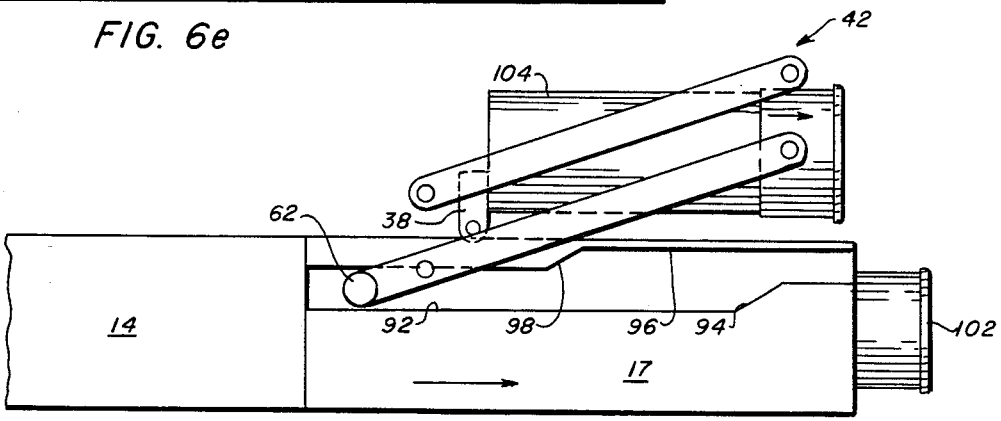
Figure 6G:
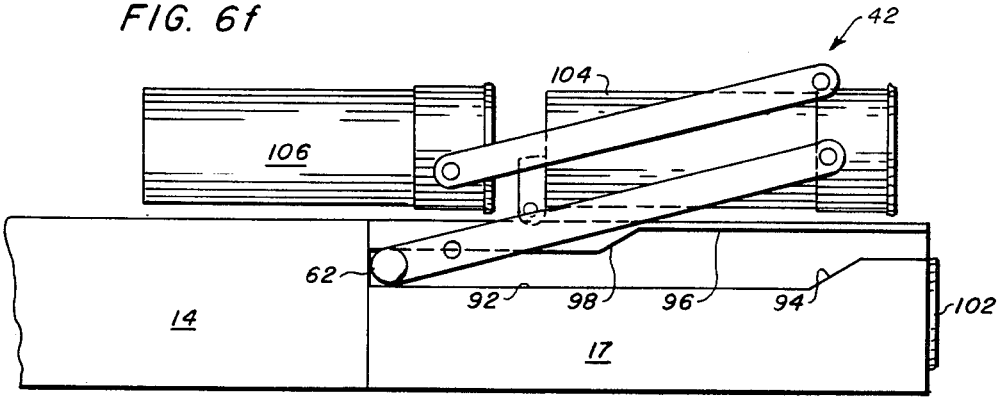

As shown in FIGS. 1 and 3, the opposite ends of the linkage members are pivotably attached through pins 66, 68, 70, 72 to a round engaging finger support member 74. Referring to FIG. 4, a pair of ammunition round engaging fingers 76, 78 having arcuate shaped inner surfaces 80, 82, for encircling and engaging the round when inserted therein, are pivotably attached to support member 74 through pins 84, 86. A spring 88 biases the fingers toward the engaged position with sufficient force to hold the round securely, see FIG. 4. Fingers 76, 78 are of a width sufficient to prevent tilting of the round while in their grasp and to assure that the round is positively held in a position co-axial with the firing chamber when transferred to the chambering position as shown in the sequential FIGS. *6a–6g*. The structure disclosed assumes that each round will be transferred from the stagging position, FIG. *6a*, to the chambering position, FIG. *6c* without loss of control over the position of the round with respect to the barrel and chamber, thereby assuring insertion of the round into the chamber without jamming.

Figure 5:
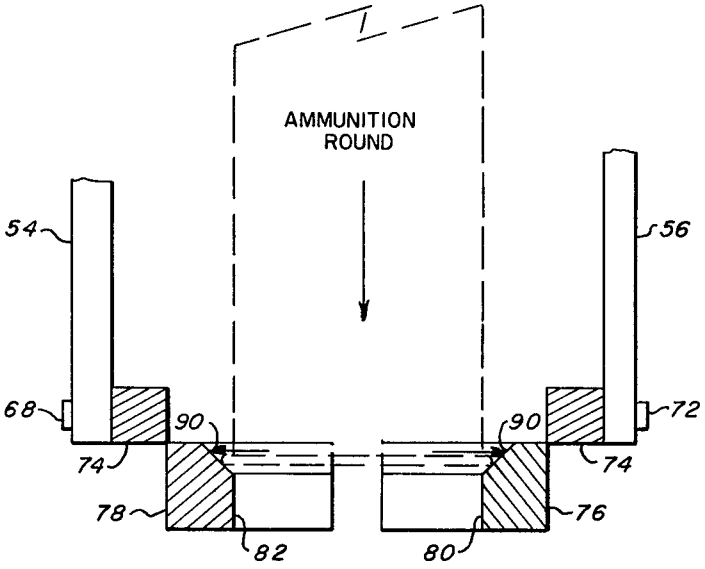
FIG. 5 is a transverse cross sectional view along 5—5 in FIG. 4 showing details and operation of the ramp on the round engaging fingers.

Referring to FIGS. 3 and 5, each finger 76, 78 includes a ramp, such as a chamfer 90, on there inner surfaces 80, 82 facing the magazine. The ramp provides a surface upon which the next round moving from the magazine to the stagging position may act to spread the fingers apart, as shown by the arrows in FIG. 5. As the fingers spread, the round moves between the fingers into the stagging position and is encircled and captured by the spring loaded fingers.

As shown in FIGS. 1, *6a–6c*, stripper tab 38 extends outwardly from the chamber assembly such that, as the chamber assembly travels forward, the tab will strike the bottom of the next round in the magazine. The tab folds down and rides beneath the round until the chamber has reached its full travel, whereat the tab clears the round and returns to the extended position as shown in FIG. *6c*. As the chamber returns to the battery position, the tab forces the round out of the magazine into engagement with the round engaging fingers.

The movement of the cam follower over the cam path causes the four bar linkage arrangement to pivot and move the round engagement assembly between the stagging and chambering positions according to a precise timed sequence as determined by the cam path.

Referring to FIGS. 1 and 2 the cam path includes a first surface 92 parallel to the chamber assembly longitudinal axis and direction of travel for causing the linkage to remain in the stagging position. The length of the surface defines the amount of forward travel of the barrel and chamber assembly that will occur before the linkage begins to rotate toward the chambering position. The length of surface 92 therefore defines the stagging position dwell time and defines a stagging position dwell surface.

The cam path includes a first ramp surface 94 at the end of the stagging surface for causing the linkage to rotate from the stagging position to the chambering position. The slope of the ramp determines the velocity of the linkage movement.

The cam path also includes a second dwell surface 96 parallel to the chamber assembly longitudinal axis for maintaining the linkage in the chambering position as the chamber assembly returns to the battery position. The length of the surface determines the time period that the linkage will remain the chambering position.

The cam path terminates in a second ramp surface 98 for causing the linkage to rotate from the chambering position back to the stagging position. Again, the ramp slope determines the velocity of the linkage movement.

PREFERRED MODE OF OPERATION

The preferred embodiment will become more clear when read in conjunction with the following description of the sequence of events in operation of the ammunition transfer mechanism.

Referring to FIGS. *6a–6g*, there is shown diagrammatically the sequence of operation of the invention. In FIG. *6a* the barrel, not shown in entirety, and chamber block 17 have moved forward an arbitrary distanced due to the firing of a round 100 in the chamber. Cam follower 62, begins to follow stagging position dwell surface 92, thereby holding the four bar linkage 42 and round engaging finger assembly, not shown, in the raised stagging position. A second round 102 is shown within the positive grasp and control of the round engaging assembly prior to being moved to the chambering position. Stripper tab 38 has contacted a third round 104 within the magazine and has begun to fold down under the round.

In FIG. *6b* the chamber block has approached the limit of its travel and stripper tab 38 is riding under the round. The cam follower is just beginning to contact first ramp 94. Spent round 100 is ejected from the weapon at this stage by conventional ejection mechanism that does not constitute part of this invention.

In FIG. *6c*, the chamber block has moved to its limit of travel allowing stripper tab 38 to return to its extended position. Cam follower 62 rises along first ramp 94 causing linkage 42 to pivot around pins 50, 58, thereby moving round 102 to the chambering position. It can be seen that positive control over the round is maintained at all times assuring that round 102 will be positioned co-axial with the chamber and barrel for insertion in the chamber without jamming.

In FIG. *6d*, the chamber assembly is returning to battery under the force of return spring 18, not shown, causing the firing chamber to receive round 102 therein. Cam follower 62 is tracing second chambering position dwell surface 96, thereby maintaining the round engagement assembly and round in the chambering position. Also, at this time, stripper tab 38 has been brought into contact with round 104 in the magazine.

In FIG. *6e*, with still further return movement of the chamber block, round 102 has been inserted sufficiently into the chamber so that it no longer requires the control of the round carrier assembly. Therefore, at this point, cam follower 62 traverses second ramp 98 causing four bar linkage 42 to pivot upward returning the round engagement assembly to the stagging position. The round engaging fingers release from the round by spreading open against the closing force of spring 88. The spreading action is created through the force exerted by the pivoting linkage overcoming the closing force of spring 88. Stripper tab 38 is simultaneously pushing round 104 toward the fingers from the magazine side of the carrier assembly.

In FIG. *6f*, the chamber block is continuing its return travel and is approching the battery position. Stripper tab 38 continues to push round 104 into ramp surface 90, see FIG. 5, causing the fingers to spread and receive the new round.

In FIG. *6g* round 102 has been completely chambered and round 104 is held securely waiting for the sequence to repeat. Another round 106 has been positioned in the magazine to be transferred.

Having described the preferred embodiment and its operation, other embodiments and modifications will readily come to the mind of those skilled in the art having the benefit of said description and accompanying drawings. Therefore, it is contemplated that said embodiments and modifications are to be considered within the scope of the appended claims.

We claim:

1. An ammunition transfer device for use in an automatic gun of the type having a magazine holding individual rounds and a reciprocating barrel comprising:

a chamber block having a firing chamber therein and a cam path on at least one external surface, said chamber block reciprocates with the barrel between a battery position and a forward position;

a round carrier pivotally attached to the gun and operatively connected to the cam path on the chamber block, said round carrier moves in timed relation with said chamber block reciprocation as defined by the cam path between a stagging position for receiving the round from the magazine and a chambering position for positioning the round received therein co-axial with the firing chamber for insertion therein, said round carrier adapted to maintain control over the position of the round in its receipt providing for repetitive co-axial positioning of all individual rounds;

said round carrier including a support member pivotally attached to bar linkage which linkage includes at least one cam follower traveling in the cam path;

a pair of accurately shaped fingers pivotally attached to the support member and spring biased together for encircling and engaging the rounds for securely holding them for transfer to the chambering position;

said fingers including a ramp on inner surfaces thereof providing surfaces for receiving a force for spreading the fingers apart for receiving the round therebetween; and means mounted on said chamber block adapted to move in timed relation with said chamber block reciprocation and round carrier movement for stripping the rounds from the magazine and moving the round stripped therefrom into engagement with said round carrier to be received therein.

2. The invention according to claim 1 wherein the means for stripping the round from the magazine comprises:

a tab pivotally attached to the chamber block for riding therewith as the chamber block moves;

said tab biased to a position normally extending outwardly from the chamber block for engaging a round in the magazine and moving it into the fingers of the round carrier.

3. The invention according to claim 2 wherein the bias on the tab allows the tab to fold about its pivot to lie closer to the chamber block as the tab is moved past the round and thereafter extend when past the round for stripping the round from the magazine upon reverse movement of the chamber block.

* * * * *